US006736089B1

(12) United States Patent
Lefebvre et al.

(10) Patent No.: US 6,736,089 B1
(45) Date of Patent: May 18, 2004

(54) METHOD AND SYSTEM FOR SOOTBLOWING OPTIMIZATION

(75) Inventors: W. Curt Lefebvre, Boston, MA (US); Daniel W. Kohn, Boston, MA (US)

(73) Assignee: NeuCo, Inc., Boston, MA (US)

( * ) Notice: Subject to any disclaimer, the term of this patent is extended or adjusted under 35 U.S.C. 154(b) by 0 days.

(21) Appl. No.: 10/455,598

(22) Filed: Jun. 5, 2003

(51) Int. Cl.[7] ..... F22B 37/48

(52) U.S. Cl. ..... 122/379; 122/390; 122/392; 15/316.1

(58) Field of Search ..... 122/379, 390, 122/392; 15/316.1

(56) References Cited

U.S. PATENT DOCUMENTS 6,325,025 B1 12/2001 Perrone ..... 122/379
6,425,352 B2 7/2002 Perrone ..... 122/379

OTHER PUBLICATIONS

Nakoneczney, et al., "Implementing B&W's Intelligent Sootblowing system at MidAmerican Energy Company's Louisa Energy Center Unit 1," Western Fuels conference, Aug. 12–13, 2002.

Sarunac, et al., "Sootblowing Optimization Helps Reduce Emissions from Coal–Fired Utility Boilers," Proceedings of the 2003 MEGA Symposium, Washington D.C., May 19–22, 2003.

*Primary Examiner*—Jiping Lu
(74) *Attorney, Agent, or Firm*—Hale and Dorr LLP

(57) ABSTRACT

A controller determines and adjusts system parameters, including cleanliness levels or sootblower operating settings, that are useful for maintaining the cleanliness of a fossil fuel boiler at an efficient level. Some embodiments use a direct controller to determine cleanliness levels and/or sootblower operating settings. Some embodiments use an indirect controller, with a system model, to determine cleanliness levels and/or sootblower settings. The controller may use a model that is, for example, a neural network, or a mass energy balance, or a genetically programmed model. The controller uses input about the actual performance or slate of the boiler for adaptation. The controller may operate in conjunction with a sootblower optimization system that controls the actual settings of the sootblowers. The controller may coordinate cleanliness settings for multiple sootblowers and/or across a plurality of heat zones in the boiler.

51 Claims, 5 Drawing Sheets

METHOD AND SYSTEM FOR SOOTBLOWING OPTIMIZATION

FIELD OF THE INVENTION

The invention relates generally to increasing the efficiency of fossil fuel boilers and specifically to optimizing sootblower operation in fossil fuel boilers.

BACKGROUND OF THE INVENTION

The combustion of coal and other fossil fuels during the production of steam or power produces combustion deposits, i.e., slag, ash and/or soot, that accumulate on the surfaces in the boiler. These deposits generally decrease the efficiency of the boiler, particularly by reducing heat transfer in the boiler. When combustion deposits accumulate on the heat transfer tubes that transfer the energy from the combustion to water, creating steam, for example, the heat transfer efficiency of the tubes decreases, which in turn decreases the boiler efficiency. To maintain a high level of boiler efficiency, the boiler surfaces are periodically cleaned. These deposits are periodically removed by directing a cleaning medium, e.g., air, steam, water, or mixtures thereof, against the surfaces upon which the deposits have accumulated at a high pressure or high thermal gradient with cleaning devices known generally in the art as sootblowers. Sootblowers may be directed to a number of desired points in the boiler, including the heat transfer tubes.

To avoid or eliminate completely the negative effects of combustion deposits on boiler efficiency, the boiler surfaces and, in particular, the heat transfer tubes, would need to be essentially free of deposits at all times. Maintaining this level of cleanliness would require virtually continuous cleaning. Maintaining completely soot-free boilers is not practical under actual operating conditions because the cleaning itself is expensive and creates wear and tear on the boiler system. Cleaning generally requires diverting energy generated in the boiler, which negatively impacts the efficiency of the boiler and makes the cleaning costly. Injection of the cleaning medium into the boiler also reduces the efficiency of the boiler and prematurely damages heat transfer surfaces in the boiler, particularly if they are over-cleaned. Boiler surfaces, including heat transfer tubes, can also be damaged as a result of erosion by high velocity air or steam jets and/or as a result of thermal inpact from jets of a relatively cool cleaning medium, especially air or liquid, impinging onto the hot boiler surfaces, especially if they are relatively clean. Boiler surface and water wall damage resulting from sootblowing is particularly costly because correction requires boiler shutdown, cessation of power production, and immediate attention that cannot wait for scheduled plant outages. Therefore, it is important that these surfaces not be cleaned unnecessarily or excessively.

The goal of maximizing boiler cleanliness is balanced against the costs of cleaning in order to improve boiler efficiency and, ultimately, boiler performance. Accordingly, reasonable, but less than ideal, boiler cleanliness levels are typically maintained in the boiler. Sootblower operation is regulated to maintain those selected cleanliness levels in the boiler. Different areas of the boiler may accumulate deposits at different rates and require different levels of cleanliness and different amounts of cleaning to attain a particular level of cleanliness. A boiler may be characterized by one or more heat zones, each heat zone having its heat transfer efficiency and cleanliness level measured and set individually. A boiler may contain, for example, 35 or even 50 heat zones. It is important that these cleanliness levels be coordinated in order to satisfy the desired boiler performance goals. A heat zone may include one or more sootblowers, as well as one or more sensors.

Sootblowers may operate subject to a number of parameters that determine how the sootblower directs a fluid against a surface, including jet progression rate, rotational speed, spray pattern, fluid velocity, media cleaning pattern, and fluid temperature and pressure. The combination of settings for these parameters that is applied to a particular sootblower determines its cleaning efficiency. These settings can be varied to change the cleaning efficiency of the sootblower. The cleaning efficiency of the sootblowers can be manipulated to maintain the desired cleanliness levels in the boiler. In addition, the frequency of operation of sootblowers can be determined according to different methods. For example, sootblowers can be operated on a time schedule based on past experience, or on measured boiler conditions, such as changes in the heat transfer rate of the heat transfer tubes. Boiler conditions may be determined by visual observation, by measuring boiler parameters, or by the use of sensors on the boiler surfaces to measure conditions indicative of the level of soot accumulation, e.g., heat transfer rate degradation of the heat transfer tubes.

One type of known system is designed to maintain a predefined cleanliness level by controlling the sootblower operating parameters for one or more sootblowers. After the sootblower is operated to clean a surface, one or more sensors are used to measure the heat transfer improvement resulting from the cleaning operation, and determine the effectiveness of the immediately preceding sootblowing operation in cleaning the surface. The measured cleanliness data is compared against the predefined cleanliness standard that is stored in the processor. One or more sootblower operating parameters can be adjusted to alter the aggressiveness of the next sootblowing operation based on the relative effectiveness of the previous sootblowing operation and the boiler operating conditions. The goal is to maintain the required level of heat transfer surface cleanliness for the current boiler operating conditions while minimizing the detrimental effects of sootblowing. The general boiler operating conditions may be determined by factors such as fuel/air mixtures, feed rates, and the type of fuel used. Given the operating conditions, the system determines the sootblower operating parameters that can be used to approximate the required level of heat transfer surface cleanliness, using a database of historical boiler operating conditions and their corresponding operating parameters as a starting point.

Boiler operation is generally governed by one or more boiler performance goals. Boiler performance is generally characterized in terms of heat rate, capacity, net profit, and emissions (e.g., NOx, CO), as well as other parameters. One principle underlying the cleaning operation is to maintain the boiler performance goals. The above-described system does not relate the boiler performance to the required level of heat surface cleanliness and, therefore, to the optimum operating parameters. The system assumes that the optimal soot level efficiency set point, i.e., the required level of heat surface cleanliness, is given: it may be entered by an operator, for example. Accordingly, the system assumes that required cleanliness levels for desired boiler performance goals are determined separately and provides no mechanism for selecting cleanliness levels for individual heat zones, for coordinating the cleanliness levels for different heat zones in a boiler, for coordinating sootblower parameters according to different cleanliness levels, i.e., in different heat zones, or for coordinating the cleanliness levels as a function of the boiler performance objectives, in terms of the boiler outputs. Accordingly, although achieving boiler performance targets is a primary objective in operating a boiler, the sootblower operating settings are not related to the boiler performance targets in the prior art system.

As discussed above, because different parts of a boiler may require different amounts of monitoring and cleaning, a boiler is typically divided into one or more heat zones, each of which may be set to a different cleanliness level. The required cleanliness levels for the different heat zones in a boiler should be carefully selected and coordinated to achieve particular boiler performance goals. Not only can performance goals change, but selecting performance goals does not necessarily determine the efficiency set points for the sootblowers in the system. The desired cleanliness levels for desired performance targets are not necessarily known beforehand. The efficiency set points of the sootblowers that are necessary to achieve a given set of performance values may vary, for example, according to the operating conditions of the boiler. In addition, the sootblower operating settings that are useful to achieve a given set of performance values are not necessarily known beforehand and will also vary according to the operating conditions of the boiler and other factors. A need exists for a method and system for determining cleanliness levels and/or sootblower operating parameters using boiler performance targets. A need exists for a method and system for determining and coordinating a complete set of cleanliness factors for the heat zones in a boiler using boiler performance targets.

SUMMARY OF THE INVENTION

Embodiments of the present invention are directed to methods and systems for improving the operating efficiency of fossil fuel boilers by optimizing the removal of combustion deposits. Embodiments of the present invention include methods and systems for determining and effecting boiler cleanliness level targets and/or sootblower operating settings.

One aspect of the invention includes using boiler performance goals to determine cleanliness tar gets and/or operating settings. One aspect of the present invention includes using an indirect controller that uses a system model of the boiler that relates cleanliness levels in the boiler to the performance of the boiler. The indirect controller additionally implements a strategy to achieve the desired cleanliness levels. The system model predicts the performance of the boiler; the primary performance parameter may be the heat rate of the boiler or $NO_x$, for example. In some embodiments of the invention, in operation, the inputs to the system model are current cleanliness conditions and boiler operating conditions; the outputs of the model are predicted boiler performance values. In some embodiments of the invention, the system model may be, for example, a neural network or a mass-energy balance model or a genetically programmed model. The model may be developed using actual historical or real-time performance data from operation of the unit. In various embodiments, the performance objectives may be specified in different ways. For example, the controller may be directed to minimize the heat rate, or to maintain the heat rate below a maximum acceptable heat rate.

In another aspect of the invention, the invention may further include a sootblower optimization subsystem designed to maintain cleanliness levels. In embodiments of this aspect of the invention, an indirect controller may use the system model to specify the desired cleanliness levels and then communicate them to the sootblower optimization subsystem, for example, to attain the unit's performance goals or to maximize the unit's performance. In another aspect of the invention, a sootblower optimization subsystem includes an indirect controller that adjusts the operating settings of the sootblowers based on target cleanliness factors.

In another aspect of the invention, the invention includes an indirect controller that uses a system model to adjust directly the sootblower operating parameters to satisfy the performance objectives. In certain embodiments of the invention, the system model relates the sootblower operating parameters to the performance of the boiler.

In another aspect of the present invention, a direct controller determines desired cleanliness levels in the boiler as a function of the performance of the boiler, without requiring a system model of the boiler. In some embodiments of the invention, in operation, the inputs to the direct controller are current cleanliness conditions and boiler operating conditions and performance goals; the outputs of the model are desired cleanliness levels. In another aspect of the invention, the direct controller relates sootblower operating parameters to the performance of the boiler and adjusts the sootblower operating parameters directly. The direct controller may be a neural controller, i.e., it may be implemented as a neural network. In some embodiments, evolutionary programming is used to construct, train, and provide subsequent adaptation of the direct controller. In some embodiments reinforcement learning is used to construct, train, and provide subsequent adaptation of the controller. The direct controller may be developed using actual historical or real-time performance data from operation of the unit.

In another aspect of the invention, in embodiments including a sootblower optimization subsystem, a direct controller adjusts the desired cleanliness levels and transmits them to the sootblower optimization subsystem (without the assistance of a system model) to attain the unit's performance goals.

In certain embodiments, the direct or indirect controller is adaptive. The controller or system model can be retrained periodically or as needed in order to maintain the effectiveness of the controller over lime.

One advantage of certain embodiments of the present invention is that cleanliness levels can be determined in terms of the performance of the boiler, eliminating the need to determine and enter target cleanliness levels separately. Another advantage of certain embodiments of the present invention is that cleanliness levels for different heat zones in the boiler can be determined comprehensively and coordinated. Another advantage of certain embodiments of the invention is that sootblower operating parameters can be determined in terms of the performance of the boiler, eliminating the need to determine desired cleanliness levels separately.

These, and other features and advantages of the present invention will become readily apparent from the following detailed description, wherein embodiments of the invention are shown and described by way of illustration of the best mode of the invention. As will be realized, the invention is capable of other and different embodiments and its several details may be capable of modifications in various respects, all without departing from the invention. Accordingly, the drawings and description are to be regarded as illustrative in nature and not in a restrictive or limiting sense, with the scope of the application being indicated in the claims.

BRIEF DESCRIPTION OF THE DRAWINGS

For a fuller understanding of the nature and objects of the present invention, reference should be made to the following detailed description taken in connection with the accompanying drawings, wherein.

DETAILED DESCRIPTION OF THE PREFERRED EMBODIMENTS

Figure 1:
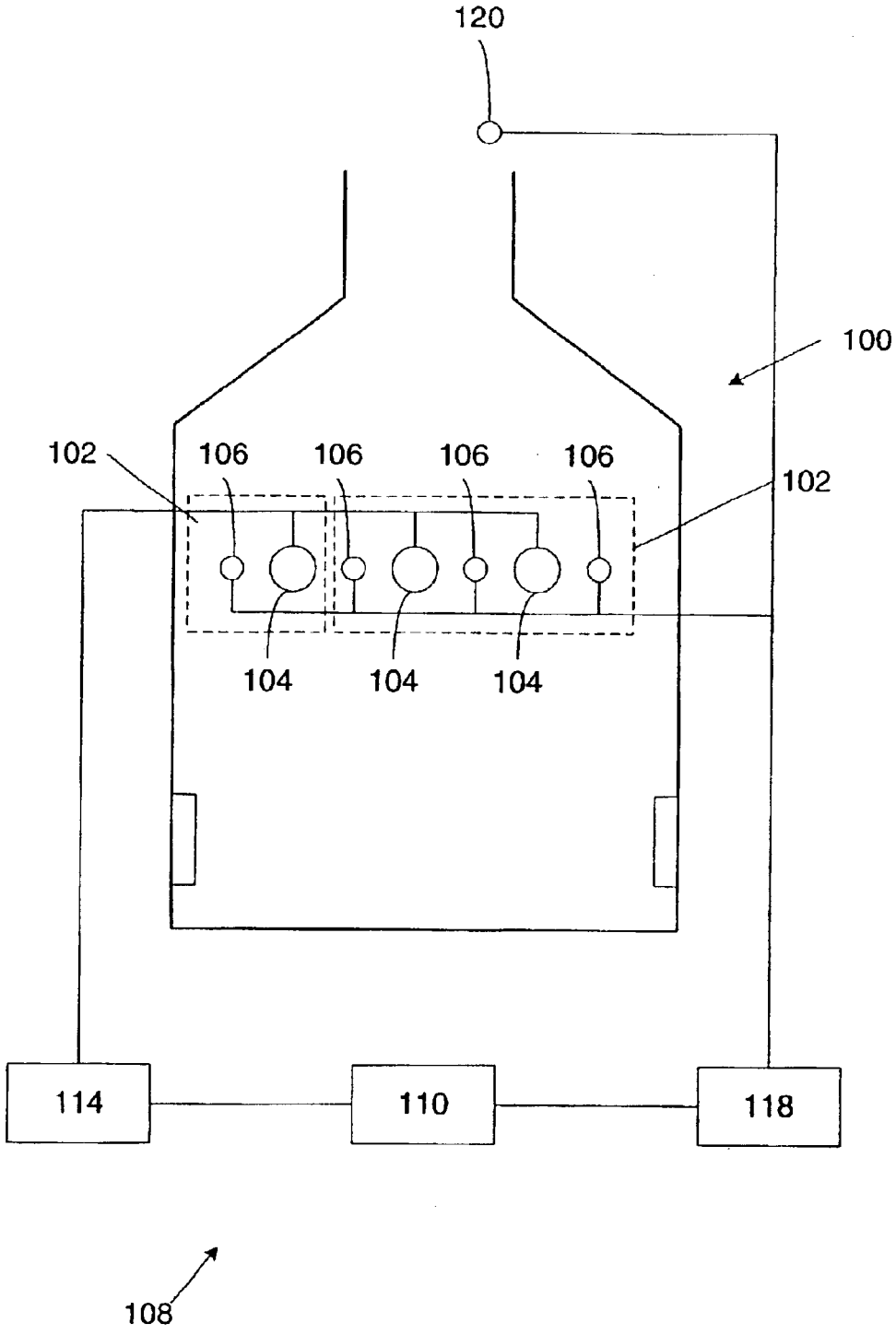
FIG. 1 is a diagram of a fossil fuel boiler with a combustion deposit removal optimization system constructed in accordance with an embodiment of the present invention.

As illustrated in FIG. 1, in order to maintain boiler efficiency, a fossil fuel boiler 100 is divided into one or more heat zones 102, each of which can separately be monitored for heat transfer efficiency. In order to clean the boiler surfaces in a heat zone 102 when the heat transfer efficiency in the heat zone 102 degrades below a desired level due to the accumulation of soot, each heat zone 102 includes one or more sootblowers 104. Each heat zone 102 also includes one or more sensors 106 that measure one or more properties indicative of the amount of soot on the boiler surfaces in the heat zone 102. The data collected by the sensors 106 is useful both for timing sootblowing operations and for determining the effectiveness of sootblowing operations. The boiler 100 includes a deposit removal optimization system 108, with a controller 110 that configures a sootblower control interface 114 in communication with sootblowers 104. The deposit removal optimization system 108 adjusts the sootblower operating parameters according to desired boiler performance goals using the controller 110. The performance monitoring system 118 evaluates one or more performance parameters, including the heat rate of the boiler 100. Performance monitoring system 118 may receive some data, e.g., emissions measurements, from sensors 120. Other performance values may be computed from received data. Performance monitoring system 118 may calculate the heat rate from data about the efficiency of the sootblowing operation and the actual cleanliness levels in the heat zones, received from sensors 106, and data about the efficiencies of other major equipment in the system. The information collected by performance monitoring system 118 is particularly useful to adapt the controller for deposit removal optimization system 108, as described hereinbelow.

In the illustrated embodiment, controller 110 is a direct controller. As discussed below, in various embodiments, deposit removal optimization system 108 may include either a direct; controller (i.e., one that does not use a system model) or an indirect controller (i.e., one that uses a system model). In embodiments in which the sootblower subsystem 108 incorporates a direct controller such as controller 110, it executes and optionally adapts (if it is adaptive) a control law that drives boiler 100 toward the boiler performance goals. Direct control schemes in various embodiments of the invention include, for example, a table or database lookup of control variable settings as a function of the process state, and also include a variety of other systems, involving multiple algorithms, architectures, and adaptation methodologies. In contemplated embodiments, a direct controller is implemented in a single phase.

In various embodiments, controller 110 may be a steady state or dynamic controller. A physical plant, such as boiler 100, is a dynamic system, namely, it is composed of materials that have response times due to applied mechanical, chemical, and other forces. Changes made to control variables or to the state of boiler 100 are, therefore, usually accompanied by oscillations or other movements that reflect the fast time-dependent nature and coupling of the variables. During steady state operation or control, boiler 100 reaches an equilibrium state such that a certain set or sets of control variable settings enable maintenance of a fixed and stable plant output of a variable such as megawatt power production. Typically, however, boiler 100 operates and is controlled in a dynamic mode. During dynamic operation or control, the boiler 100 is driven to achieve an output that differs from its current value. In certain embodiments, controller 110 is a dynamic controller. In general, dynamic controllers include information about the trajectory nature of the plant states and variables. In some embodiments, controller 110 may also be a steady-state controller used to control a dynamic operation, in which case the dynamic aspects of the plant are ignored in the control and there is a certain lag time expected for the plant to settle to steady state after the initial process control movements.

In accordance with certain embodiments of the present invention, three general classes of modeling methods are contemplated to be useful for the construction of direct controller 110. One method is a strictly deductive, or predefined, method. A strictly deductive method uses a deductive architecture and a deductive parameter set. Examples of deductive architectures that use deductive parameter sets include parametric models with preset parameters such as first principle or other system of equations. Other strictly deductive methods include preset control logic such as if-then-else statements, decision trees, or lookup tables whose logic, structure, and values do not change over time.

It is preferred that controller 110 be adaptive, to capture the off-design or time-varying nature of boiler 100. A parametric adaptive modeling method may also be used in various embodiments of the invention. In parametric adaptive modeling methods, the architecture of the model or controller is deductive and the parameters are adaptive, i.e., are capable of changing over time in order to suit the particular needs of the control system. Examples of parametric adaptive modeling methods that can be used in some embodiments of the invention include regressions and neural networks. Neural networks are contemplated to be particularly advantageous for use in complex nonlinear plants, such as boiler 100. Many varieties of neural networks, incorporating a variety of methods of adaptation, can be used in embodiments of the present invention.

A third type of modeling method, strictly non-parametric, that can also be used in embodiments of the invention uses an adaptive architecture and adaptive parameters. A strictly non-parametric method has no predefined architecture or sets of parameters or parameter values. One form of strictly non-parametric modeling suitable for use in embodiments of the invention is evolutionary (or genetic) programming. Evolutionary programming involves the use of genetic algorithms to adapt both the model architecture and its parameters. Evolutionary programming uses random, but successful, combinations of any set of mathematical or logical operations to describe the control laws of a process.

In embodiments in which controller 110 is adaptive, it is preferably implemented on-line, or in a fully automated fashion that does not require human intervention. The particular adaptation methods that are applied are, in part, dependent upon the architecture and types of parameters of the controller 110. The adaptation methods used in embodiments of the invention can incorporate a variety of types of cost functions, including supervised cost functions, unsupervised cost function and reinforcement based cost functions. Supervised cost functions include explicit boiler output data in the cost function, resulting in a model that maps any set of boiler input and state variables to the corresponding boiler output. Unsupervised cost functions require that no plant output data be used within the cost function. Unsupervised adaptation is primarily for cluster or distribution analysis.

In embodiments of the invention, a direct controller may be constructed and subsequently adapted using a reinforcement generator, which executes the logic from which the controller is constructed. Reinforcement adaptation does not utilize the same set of performance target variable data of supervised cost functions, but uses a highly restricted set of target variable data, such as ranges of what is desirable or what is bad for the performance of the boiler 100. Reinforcement adaptation involves training the controller on acceptable and unacceptable boiler operating conditions and boiler outputs. Reinforcement adaptation therefore enables controller 110 to map specific plant input data to satisfaction of specific goals for the operation of the boiler 100.

Embodiments of the invention can use a variety of search rules that decide which of a large number of possible permutations should be calculated and compared to see if they result in an improved cost function output during training or adaptation of the model. In contemplated embodiments, the search rule used may be a zero-order, first-order or second-order rule, including combinations thereof. It is preferred that the search rule be computationally efficient for the type of model being used and result in global optimization of the cost function, as opposed to mere local optimization. A zero-order search algorithm does not use derivative information and may be preferred when the search space is relatively small. One example of a zero-order search algorithm useful in embodiments of the invention is a genetic algorithm that applies genetic operators such as mutation and crossover to evolve best solutions from a population of available solutions. After each generation of genetic operator, the cost function may be reevaluated and the system investigated to determine whether optimization criteria have been met. While the genetic algorithms may be used as search rules to adapt any type of model parameters, they are typically used in evolutionary programming for non-parametric modeling.

A first-order search uses first-order model derivative information to move model parameter values in a concerted fashion towards the extrema by simply moving along the gradient or steepest portion of the cost function surface. First-order search algorithms are prone to rapid convergence towards local extrema and it is generally preferable to combine a first-order algorithm with other search methods to ensure a measure of global certainty. In some embodiments of the present invention, first-order searching is used in neural network implementation. A second-order search algorithm utilizes zero, first, and second-order derivative information.

In embodiments of the invention, controller 110 is generated in accordance with the control variables are available for manipulation and the types of boiler performance objectives defined for boiler 100. Control variables can be directly manipulated in order to achieve the control objectives, e.g., reduce $NO_x$ output. As discussed above, in certain embodiments, the sootblower operating parameters are control variables that controller 110 manages directly in accordance with the overall boiler objectives. Significant performance, parameters may include, e.g., emissions ($NO_x$), heat rate, opacity, and capacity. The heat rate or NOx output may be the primary performance factor that the sootblower optimization system 108 is designed to regulate. Desired objectives for the performance parameters may be entered into the controller 110, such as by an operator, or may be built into the controller 110. The desired objectives may include specific values, e.g., for emissions, or more general objectives, e.g., minimizing a particular performance parameter or maintaining a particular range for a parameter. Selecting values or general objectives for performance parameters may be significantly easier initially than determining the corresponding sootblower operating settings for attaining those performance values. Desired values or objectives for performance parameters are generally known beforehand, and may be dictated by external requirements. For example, for the heat rate, a specific maximum acceptable level may be provided to controller 110, or controller 110 may be instructed to minimize the heat rate.

In exemplary embodiments, controller 110 is formed of a neural network, using a reinforcement generator to initially learn and subsequently adapt to the changing relationships between the control variables, in particular, the sootblower operating parameters, and the acceptable and unacceptable overall objectives for the boiler. The rules incorporated in the reinforcement generator may be defined by a human expert, for example. The reinforcement generator identifies the boiler conditions as favorable or unfavorable according to pre-specified rules, which include data values such as NOx emission thresholds, stack opacity thresholds, CO emission thresholds, current plant load, etc. For example, the reinforcement generator identifies a set of sootblowing operating to parameters as part of a vector that contains the favorable-unfavorable plant objective data, for a single point in time. This vector is provided by the reinforcement generator to controller 110 to be used as training data for the neural network. The training teaches the neural network to identify the relationship between any combination of sootblower operating parameters and corresponding favorable or unfavorable boiler conditions. In a preferred embodiment, controller 110 further includes an algorithm to identify the preferred values of sootblower operating parameters, given the current values of sootblower operating parameters, as well as a corresponding control sequence. In certain contemplated embodiments, the algorithm involves identifying the closest favorable boiler operating region to the current region and determining the specific adjustments to the sootblower operating parameters that are required to move boiler 100 to that operating region. Multiple step-wise sootblower operating parameter adjustments may be required to attain the closest favorable boiler objective region due to rules regarding sootblower operating parameter allowable step-size or other constraints.

Figure 2:
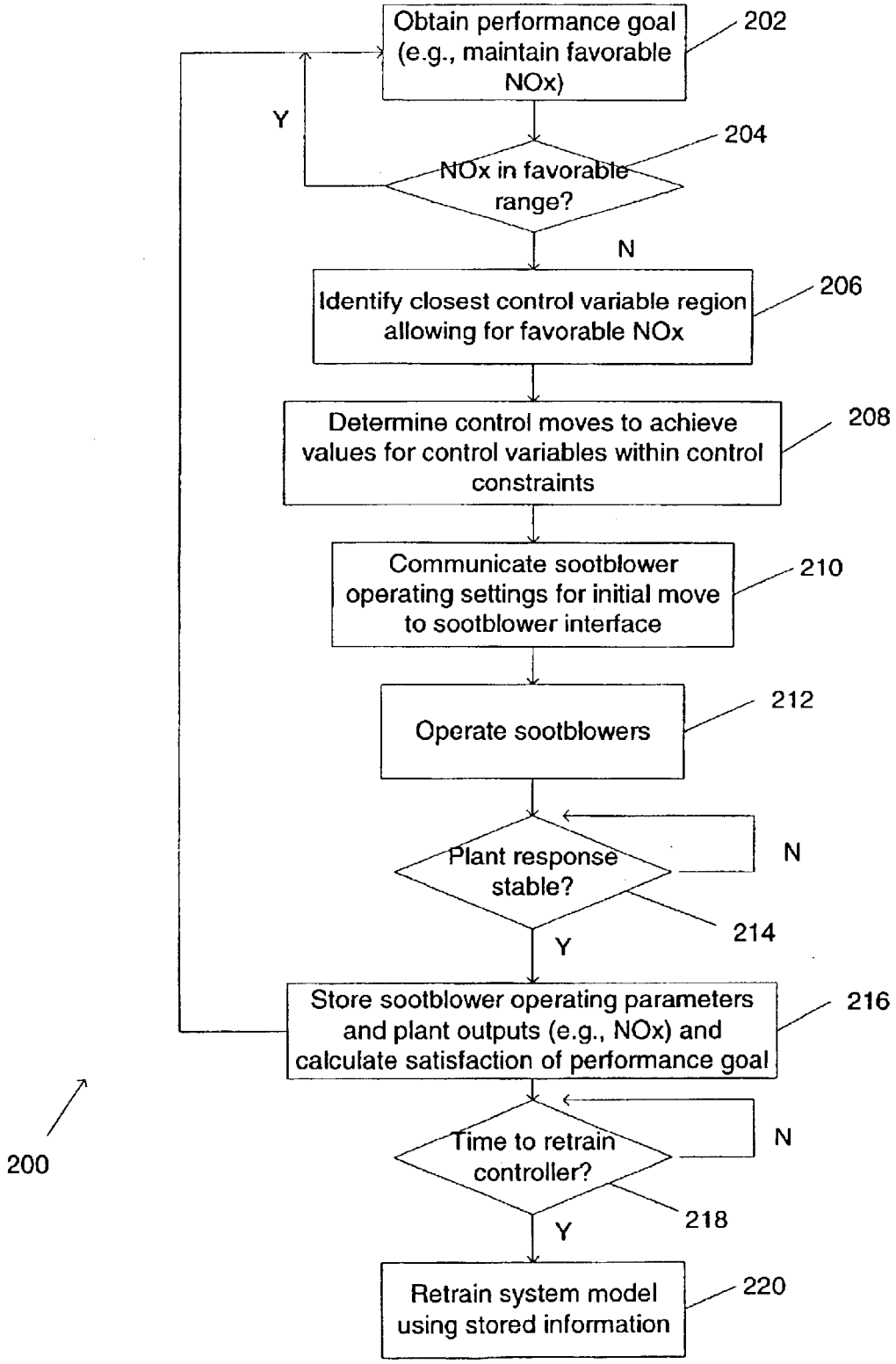
FIG. 2 is a flow chart of a method for controlling sootblowing in a fossil fuel boiler in accordance with an embodiment of the present invention.

A method for controlling sootblowers 104 using controller 110 is shown in FIG. 2. In the initial step 202, controller 110 obtains a performance goal. For example, the goal may be to prioritize maintaining the NOx output of boiler 100 in a favorable range. In step 204, controller 110 checks the present NOx output, which may be sensed by performance monitoring system 118. If the NOx output is already favorable, controller 110 maintains the present control state or executes a control step from a previously determined control sequence until a new goal is received or the plant output is checked again. If the NOx output is not favorable, in step 206, controller 110 identifies the closest control variable region allowing for favorable NOx. In one contemplated embodiment, the closest favorable boiler objective region is identified by an analysis of the boiler objective surface of the neural network of controller 110. The boiler objective surface is a function, in part, of the current boiler operating conditions. In certain embodiments, the algorithm sweeps out a circle of radius, r, about the point of current sootblowing operating settings. The radius may be calculated as the square root of the quantity that is the sum of the squares of the distance between the current setting of each sootblower parameter value and the setting of the proposed sootblower parameter value. In particular, $$\text{Radius}^2=\Sigma_i^N\alpha_i(S.P^2_{i\text{-}proposed}-S.P^2_{i\text{-}current})^2$$

for each $i^{th}$ sootblowing parameter, up to sootblowing parameter number N, with normalization coefficients $\alpha_i$. The sweep looks to identify a point on the boiler objective surface with a favorable value. If one is found in the first sweep, the radius is reduced, and the sweep repeated until the shortest distance (smallest radius) point has been identified. If a favorable plant objective surface point is not found upon the first sweep of radius r, then the radius is increased, and the sweep repeated until the shortest distance (radius) point has been identified. In a contemplated embodiment, multiple sootblowing parameters may need to be adjusted simultaneously at the closest favorable control region. By way of example, the sootblowing parameter values will include intensity, frequency, and duration measures of the sootblowing devices for each of the sootblower devices found in each of the sootblowing zones. Intensity values allow the sootblowing to occur with greater force or pressure or temperature, etc. The purpose of increasing intensity is to remove soot at a greater rate during the actual sootblowing event. Frequency values allow the sootblowing, using any single sootblowing device, to occur more often, such that there is a shorter period of time between the end of one sootblowing event and the beginning of the next. The purpose of increasing the frequency value is to remove more soot over a relatively long period of time, without having to increase intensity, which may have material degradation side effects. Duration values allow the sootblowing event itself to last longer. The purpose of increasing duration is to remove more soot without having to increase intensity or without having to change frequency. It may, for instance, be desirable to operate all sootblowing devices at the same frequency. In certain embodiments, the control move algorithm contains rules that enable prioritization, for each sootblowing device, of the order in which intensity, frequency, and duration are searched when identifying a set of sootblowing parameters targeted for adjustment.

In addition to identifying the closest control variable region that allows for satisfying the performance goal, controller 110 also determines a sequence of control moves in step 208. A number of control moves may be required because controller 110 may be subject to constraints on how many parameters can be changed at once, how quickly they can be changed, and how they can be changed in coordination with other parameters that are also adjusted simultaneously, for example. Controller 110 determines an initial control move. In step 210, it communicates that control move to the sootblowers, for example, through control interface 114. In step 212, sootblowers 104 operate in accordance with the desired operating settings. After a suitable interval, indicated in step 214, preferably when the response to the sootblowing operation is stable, the sootblower operating parameters and boiler outputs, i.e., indicators of actual boiler performance, are stored in step 216. Additionally, satisfaction of the performance goal is also measured and stored. In particular, the system may store information about whether the NOx level is satisfactory or has shown improvement. The control sequence is then repeated. In some embodiments, the identified sootblower operating settings may not be reached because the performance goal or boiler operating conditions may change before the sequence of control moves selected by the controller for the previous performance goal can be implemented, initiating a new sequence of control moves for the sootblowing operation.

As shown in step 218 and 220, the stored sootblower operating setting and boiler outputs, and the reinforcement generator's assessment of favorable and unfavorable conditions, are used on a periodic and settable basis, or as needed, as input to retrain controller 110. The regular retraining of controller 110 allows it to adjust to the changing relationship between the sootblowing parameters and the resulting boiler output values. In some embodiments of the invention, in place of controller 110 and sootblower interface 114, only a single controller is used to select the sootblower operating parameters and also operate the sootblowers 104 according to those settings.

Figure 3:
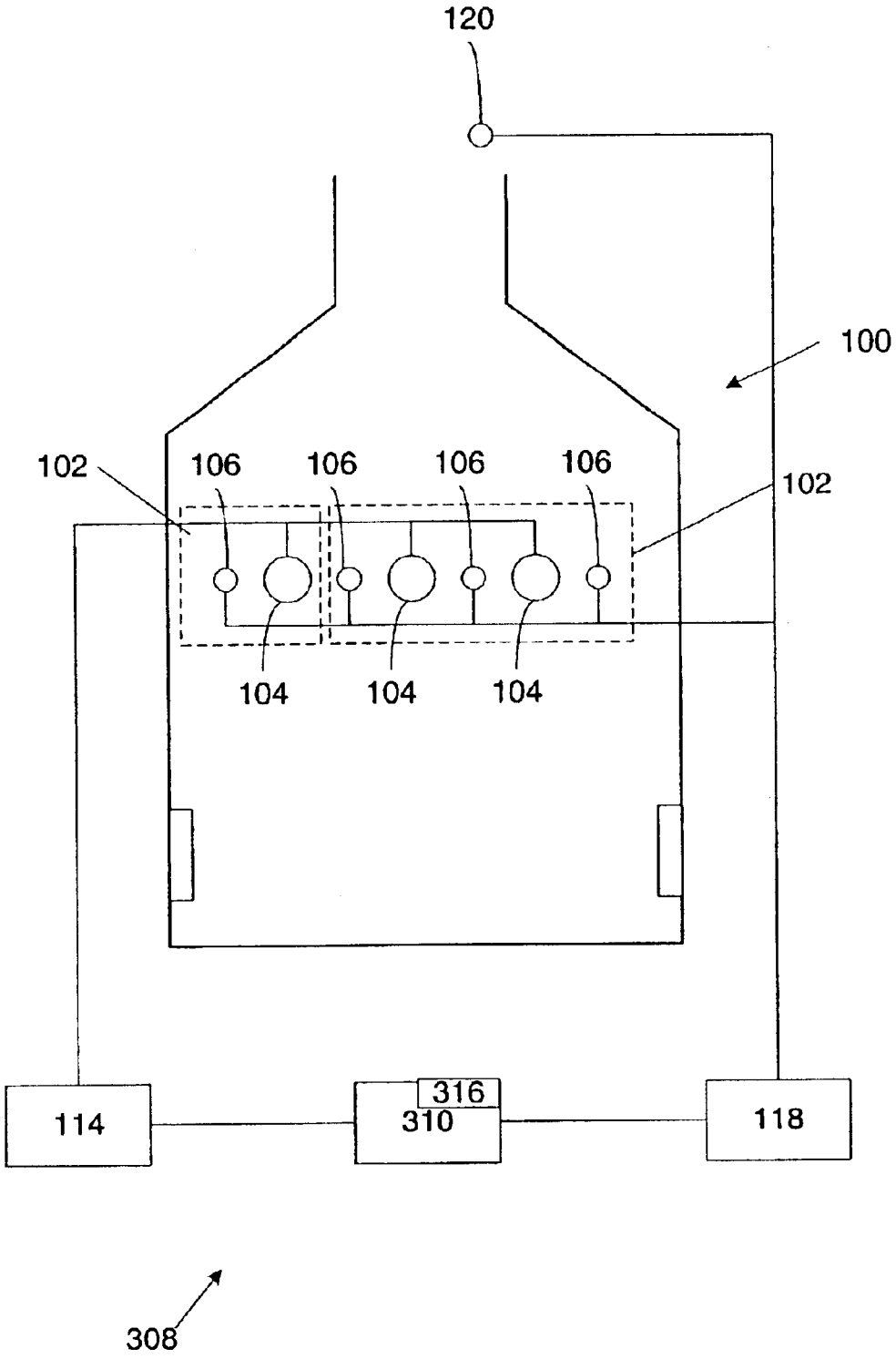
FIG. 3 is a diagram of a fossil fuel boiler with a combustion deposit removal optimization system constructed in accordance with an alternative embodiment of the present invention.

As illustrated in FIG. 3, some embodiments of the present invention may incorporate an alternative sootblowing optimization system 308. Sootblowing optimization system 308 includes a controller 310. In the illustrated embodiment, controller 310 is an indirect controller that uses a system model 316 to determine the sootblower operating parameters that are required to achieve a desired performance level of boiler 100. Similar to controller 110, controller 310 optimizes the sootblowing parameters to achieve and maintain the desired performance. In sootblower optimization system 308, controller 310 also communicates the sootblower operating settings to sootblower control interface 114. System model 316 is an internal representation of the plant response resulting from changes in its control and state variables with sootblower operating parameters among the inputs, in addition to various state variables. In such embodiments, controller 310 learns to control the cleaning process by first identifying and constructing system model 316 and then defining control algorithms based upon the system model 316. System model 316 can represent a committee of models. In various embodiments of the invention incorporating an indirect controller, controller 310 may use any number of model architectures and adaptation methods. Various implementation techniques described in conjunction with controller 110 will also be applicable to model 316. In general, model 316 predicts the performance of the boiler under different combinations of the control variables.

In various embodiments, system model 116 is a neural network, mass-energy balance model, genetic programming model, or other system model. Models can be developed using data about the actual performance of the boiler 100. For example, a neural network or genetic programming model can be trained using historical data about the operation of the boiler. A mass-energy balance model can be computed by applying first principles to historical or real-time data to generate equations that relate the performance of boiler 100 to the state of boiler 100 and the sootblower operating parameters. Data that is collected during subsequent operation of the boiler 100 can later be used to re-tune system model 116 when desired.

Figure 4:
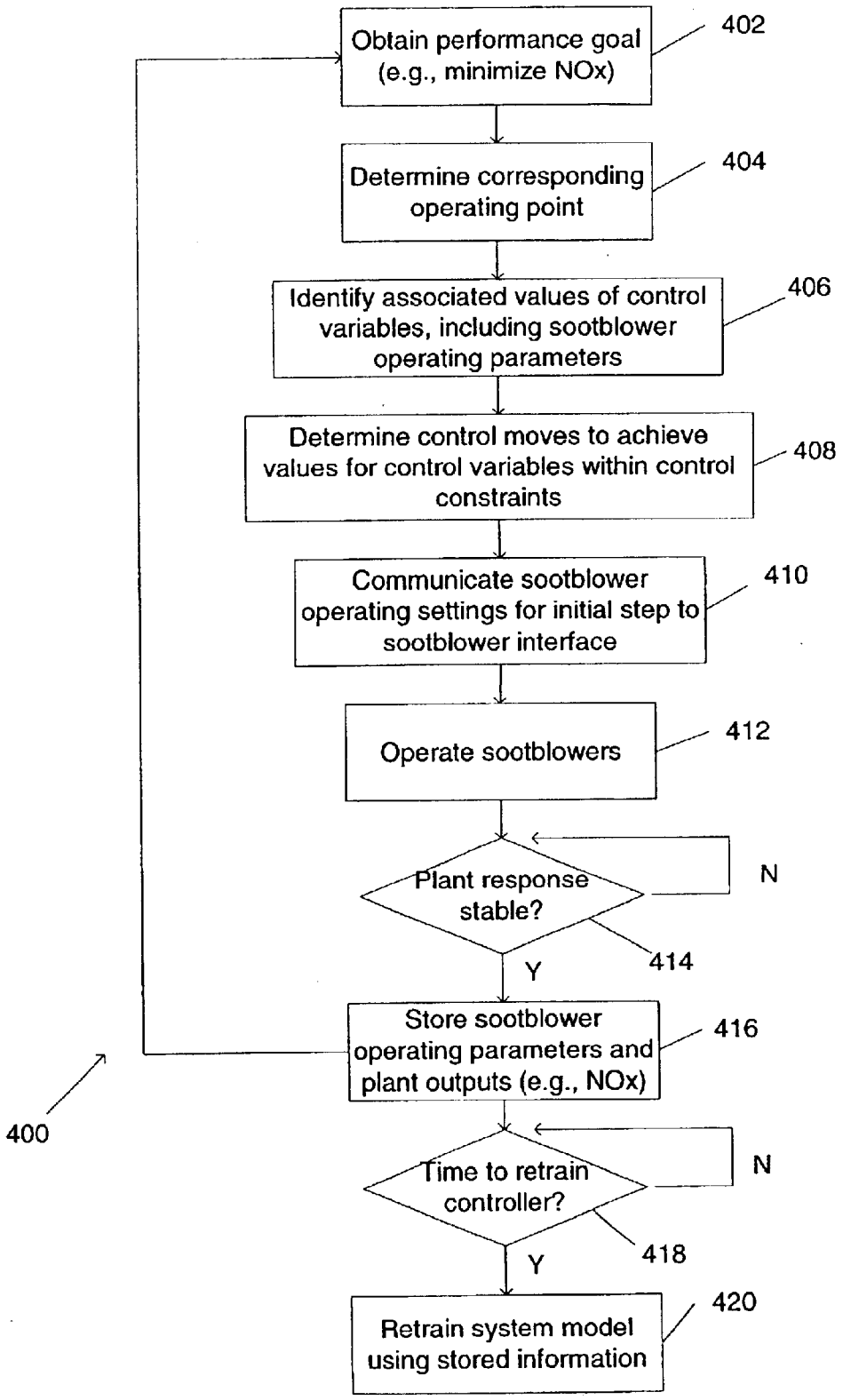
FIG. 4 is a flow chart of a method for controlling sootblowing in accordance with an embodiment of the present invention.

FIG. 4 is a flow diagram 400 showing steps of a method for removing combustion deposits in accordance with an embodiment of the invention using an indirect controller such as controller 310. As shown in step 402, initially controller 310 receives a performance goal. In various embodiments, in step 404, controller 310 uses system model 316 to identify a point on the model surface corresponding to the current boiler state that meets the current boiler performance goal, for example, minimizing NOx. In step 406, controller 310 uses system model 316 to identify the boiler inputs, such as the sootblower operating parameters, corresponding to that point that will generate the desired boiler outputs. In step 408, controller 310 determines control moves to achieve values for control variables within control constraints as with controller 110. In step 410, controller 310 communicates sootblower operating settings for the initial step to sootblower control interface 114. In step 414, sootblowers 104 operate in accordance with the sootblower operating settings.

After a suitable interval, preferably after the plant response is stable, as shown in step 416, the sootblower operating parameters and plant outputs, such as the NOx output, are stored. The control cycle is repeated after suitable intervals. As shown in step 418, from time to time, controller 314 and/or model 316 are determined to require retraining. Accordingly, system model 316 is retrained using the information stored in step 416.

Figure 5:
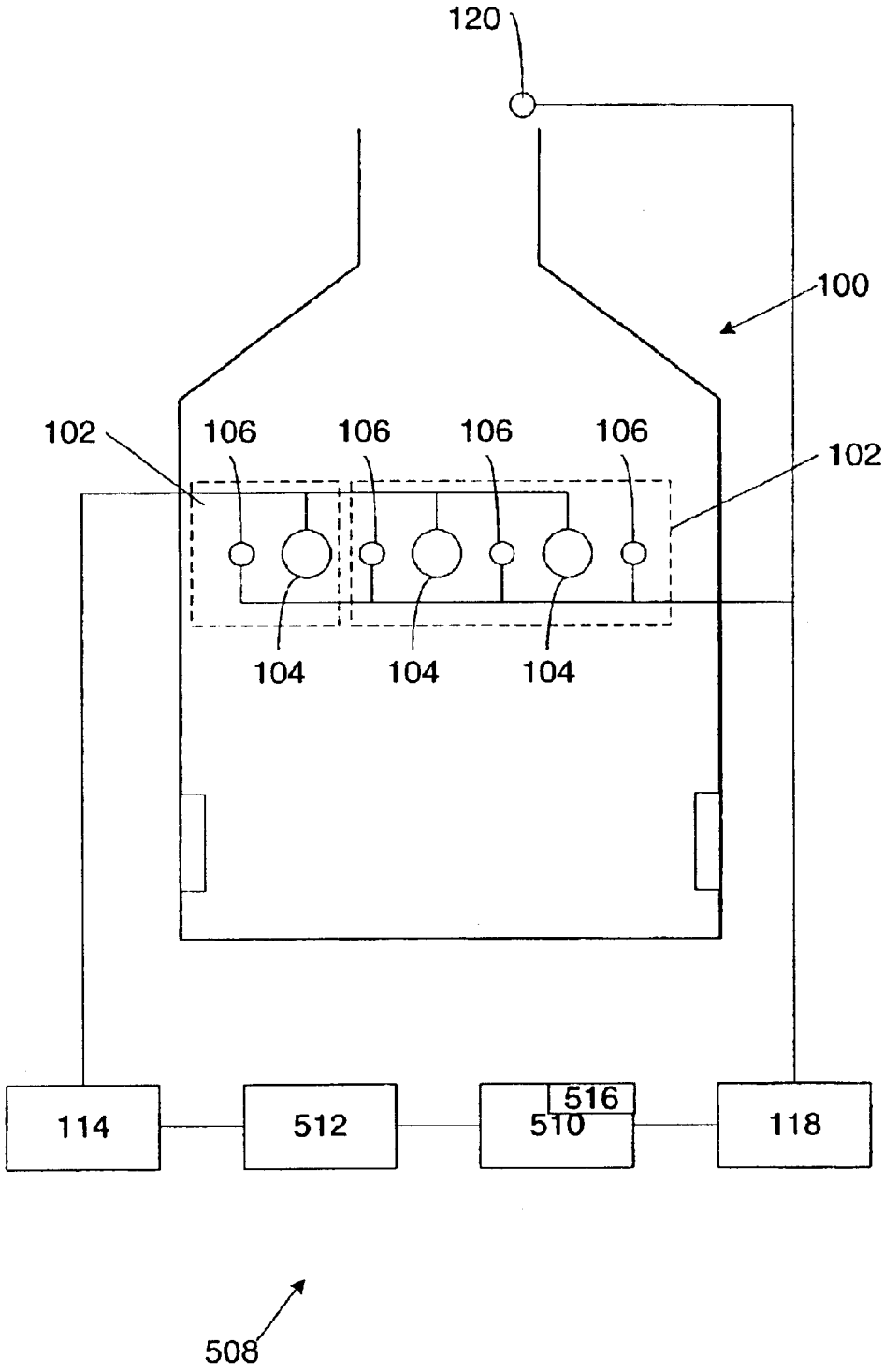
FIG. 5 is a diagram of a fossil fuel boiler with a combustion deposit removal optimization system constructed in accordance with an alternative embodiment of the present invention.

In an alternate embodiment, shown in FIG. 5, the controller 510 is an indirect controller and uses a system model 516 to determine a set of cleanliness factors for the set of heat zones 102 in the boiler 100 that are required to achieve or approximate as closely as possible a desired performance level of the boiler 100. In alternate embodiments, controller 510 can be a direct controller that determines the set of cleanliness factors. In either type of embodiment, cleanliness levels are determined as functions of the boiler performance goals, which are generally known or readily definable. In one embodiment, controller 510 uses system model 516 to evaluate the effects of different sets of cleanliness levels under the current boiler operating conditions and determine one or more sets of cleanliness levels that will satisfy the desired performance objective. Controller 510 receives as input the current boiler state, including the current cleanliness levels, and desired performance goals. As discussed above, boiler operating conditions generally include fuel/air mixtures, feed rates, the type of fuel used, etc. Cleanliness levels in boiler 100 are state variables, not control variables. Accordingly, it is contemplated that corresponding sootblower operating parameters to move boiler 100 to the desired state must be computed separately. As illustrated in FIG. 5, the controller 510 is in communication with a processor 512 that optimizes sootblower operating parameters to maintain given cleanliness levels. Controller 510 transmits sets of cleanliness levels to processor 512. Processor 512 optimizes the sootblower operating parameters to maintain the received cleanliness levels. Processor 512 in turn is in communication with a sootblower control interface 114 and transmits the desired sootblower operating parameters to the sootblower control interface 114 as necessary.

As illustrated, a single controller 110, 310, or 510 or processor 512 may handle all of the heat zones 102 in the boiler. Alternatively, multiple controllers or processors may be provided to handle all of the heat zones 102 in the boiler 100.

In another embodiment of the invention, processor 512 is an indirect controller that incorporates a system model that relates the sootblower operating parameters to the cleanliness levels in heat zones 102. Processor 512 uses a process similar to the process shown in FIG. 4 to determine a set of sootblower operating settings from a received set of desired cleanliness levels using a system model. Processor 512 receives as inputs the current boiler operating conditions, including the current cleanliness levels measured by sensors 106, as well as the set of desired cleanliness levels. The set of desired cleanliness levels provide the performance goal for the processor 512. Using the system model, processor 512 identifies the corresponding operating point and then selects one or more control moves to attain the desired operating point. The system model incorporated in processor 512 can be retrained periodically or as needed. The system model can also be represented as a committee of models.

In some embodiments of the invention a single controller, as that described heretofore as controller 110, may be integrated with processor 512 and control interface 114. In this integrated embodiment, the controller may compute both desired cleanliness levels and sootblower operating parameters expected to attain those cleanliness levels. In another embodiment of the invention, a single indirect controller may result from the integration of the function of processor 512 and control interface 114. In this integrated embodiment, the indirect controller will compute and control the sootblower parameters necessary to attain the desired cleanliness levels specified by the output of controller 110.

Controllers 110, 310 in the illustrated embodiments of the invention is, preferably, software and runs the model 316 also, preferably, software to perform the computations described herein, operable on a computer. The exact software is not a critical feature of the invention and one of ordinary skill in the art will be able to write various programs to perform these functions. The computer may include, e.g., data storage capacity, output devices, such as data ports, printers and monitors, and input devices, such as keyboards, and data ports. The computer may also include access to a database of historical information about the operation of the boiler. Processor 112 is a similar computer designed to perform the processor computations described herein.

As referenced above, various components of the sootblower optimization system could be integrated. For example, the sootblower control interface 114, the processor 512, and the model-based controller 510 could be integrated into a single computer; alternatively model-based controller 310 and sootblower interface 114 could be integrated into a single computer. The controller 110, 310 or 510 may include an override or switching mechanism so that efficiency set points or sootblower optimization parameters can be set directly, for example, by an operator, rather than by the model-based controller when desired. While the present invention has been illustrated and described with reference to preferred embodiments thereof, it will be apparent to those skilled in the art that modifications can be made and the invention can be practiced in other environments without departing from the spirit and scope of the invention, set forth in the accompanying claims.

What is claimed is:

1. A system for controlling removal of combustion deposits in a boiler, one or more heat zones being defined in the boiler, each heat zone having a cleanliness level and being associated with an adjustable desired cleanliness level during the operation of the boiler, the performance of the boiler being characterized by boiler performance parameters, comprising:

a controller input for receiving a performance goal for the boiler corresponding to at least one of the boiler performance parameters and for receiving data values corresponding to boiler state variables and to the boiler performance parameters, said boiler state variables including current cleanliness levels;

a system model that relates the cleanliness levels in the boiler to the boiler performance parameters;

an indirect controller that determines a set of desired cleanliness levels to satisfy the performance goal for the boiler, said indirect controller using the system model, the received data values and the received performance goal to determine the set of desired cleanliness levels; and a controller output that outputs the set of desired cleanliness levels.

2. The system of claim 1, further comprising a performance monitoring system in communication with said controller input, the performance monitoring system including at least one performance sensor to measure the data values, said performance monitoring system providing the data values to the indirect controller.

3. The system of claim 1, wherein said system model is a neural network.

4. The system of claim 1, wherein said system model is a mass-energy balance model.

5. The system of claim 1, wherein said system model is a genetically programmed model.

6. The system of claim 1, further comprising a sootblower subsystem in communication with the controller output for receiving the set of desired cleanliness levels in the boiler, the sootblower subsystem including one or more sootblowers and a controller for instructing the one or more sootblowers to maintain the set of desired cleanliness levels in the boiler.

7. A system for determining desired sootblower operating settings for one or more sootblowers in a boiler, the operation of the one or more sootblowers being characterized by one or more adjustable sootblower operating parameters, the operation of the boiler being characterized by boiler performance parameters, comprising:

a controller input for receiving a performance goal for the boiler corresponding to at least one of the boiler performance parameters and for receiving data values corresponding to boiler state variables and to the boiler performance parameters;

a system model that relates the sootblower operating settings to the boiler performance parameters;

an indirect controller that determines desired sootblower operating settings to satisfy the received performance goal for the boiler using the system model, the received performance goal for the boiler and the received data values; and a controller output that outputs the desired sootblower operating settings.

8. The system of claim 7, a performance monitoring system in communication with said indirect controller, including a performance sensor to measure the data values, said performance monitoring system providing the data values to the indirect controller.

9. The system of claim 7, wherein said system model is a neural network.

10. The system of claim 7, wherein said system model is a mass-energy balance model.

11. The system of claim 7, wherein said system model is a genetically programmed model.

12. The system of claim 7, further comprising a plurality of sootblowers, said controller output being in communication with said plurality of sootblowers, said plurality of sootblowers operating according to said desired sootblower operating settings.

13. A system for determining a set of desired cleanliness levels in a boiler, one or more heat zones being defined in the boiler, each heat zone having a cleanliness level and being associated with an adjustable desired cleanliness level during the operation of the boiler, the performance of the boiler being characterized by boiler performance parameters, comprising:

a controller input for receiving a performance goal for the boiler corresponding to at least one of the boiler performance parameters and for receiving data values corresponding to boiler state variables and to the boiler performance parameters, said boiler state variables including current cleanliness levels;

a direct controller that determines a set of desired cleanliness levels to satisfy the performance goal for the boiler, said direct controller using the received data values and the received performance goal to determine the set of desired cleanliness levels; and a controller output that outputs the set of desired cleanliness levels.

14. The system of claim 13, further comprising a performance monitoring system in communication with said controller input, the performance monitoring system including at least one performance sensor to measure the data, said performance monitoring system providing the data values to the direct controller.

15. The system of claim 13, wherein said controller is a neural network.

16. The system of claim 13, wherein said controller is a mass-energy balance.

17. The system of claim 13, wherein said controller model is genetically programmed.

18. The system of claim 13, further comprising a sootblower subsystem in communication with the controller output for receiving the set of desired cleanliness levels in the boiler, the sootblower subsystem including one or more sootblowers and a controller for instructing the one or more sootblowers to maintain the set of desired cleanliness levels in the boiler.

19. A system for determining desired sootblower operating settings for a plurality of sootblowers, the operation of the sootblowers being characterized by one or more sootblower operating parameters, in a boiler, the performance of the boiler being characterized by boiler performance parameters, comprising:

a controller input for receiving a performance goal for the boiler corresponding to at least one of the boiler performance parameters and for receiving data values corresponding to boiler state variables and the boiler performance parameters;

a direct controller that determines desired sootblower operating settings to satisfy the performance goal for the boiler, said direct controller using the received performance goal for the boiler and the received data values; and a controller output that outputs the desired sootblower operating settings.

20. The system of claim 19, a performance monitoring system in communication with said direct controller, including a performance sensor to measure the data values, said performance monitoring system providing the data values to the direct controller.

21. The system of claim 19, wherein said system model is a neural network.

22. The system of claim 19, wherein said system model is a mass-energy balance model.

23. The system of claim 19, wherein said system model is a genetically programmed model.

24. A system for controlling the removal of combustion deposits from a fossil fuel boiler, one or more heat zones being defined in the boiler, each heat zone having a cleanliness level and being associated with an adjustable desired cleanliness level during the operation of the boiler, comprising:

a sootblower in at least one of said heat zones, said sootblower being positioned to clean a surface in said heat zone, said sootblower operating in accordance with adjustable operating parameters;

a sensor associated with said heat zone that detects an actual cleanliness level of the surface; and an in direct controller that determines the sootblower operating settings, including a system model that relates sootblower operating settings to desired cleanliness levels, said indirect controller having a controller input in communication with said sensor, the indirect controller using the actual cleanliness level of the surface, the system model, and the desired cleanliness level for the heat zone to determine operating settings for the sootblower, and further including a controller output in communication with said sootblower to transmit said sootblower operating settings to said sootblower.

25. A method for determining desired cleanliness levels in a boiler, one or more heat zones being defined in the boiler, each heat zone having a cleanliness level and being associated with a desired cleanliness level during the operation of the boiler, the performance of the boiler being characterized by one or more boiler performance parameters, comprising the steps of:

implementing a controller with a system model that relates the cleanliness levels in the boiler to the performance of the boiler;

obtaining a performance goal for the boiler;

receiving data corresponding to the boiler performance parameters and boiler state variables;

determining an operating point corresponding to the performance goal using the system model;

identifying a set of desired cleanliness levels associated with the operating point using the system model; and communicating said set of desired cleanliness levels to a sootblower subsystem.

26. The method of claim 25, wherein said system model is implemented using historical data about the operation of the boiler.

27. The method of claim 25, wherein said system model is implemented using a neural network.

28. The method of claim 25, wherein said system model is implemented using a mass-energy balance.

29. The method of claim 25, wherein said system model is implemented using genetic programming.

30. The method of claim 25, further including the step of storing information about the control move and corresponding measured boiler performance values and retraining the system model using the stored information.

31. A method for determining sootblower operating settings for a plurality of sootblowers, the operation of the sootblowers being characterized by one or more sootblower operating parameters, in a boiler, the performance of the boiler being characterized by one or more boiler performance parameters, comprising the steps of:

implementing a controller with a system model that relates the sootblower operating parameters to the boiler performance parameters;

obtaining a performance goal for the boiler;

receiving data corresponding to the boiler performance parameters and boiler state variables;

determining an operating point corresponding to the performance goal using the system model;

identifying a set of sootblower operating settings associated with the operating point using the system model;

determining a control move using the set of sootblower operating settings for directing the boiler to the operating point; and communicating said control move to said one or more sootblowers to adjust the sootblower operating parameters.

32. The method of claim 31 wherein said system model is implemented using historical data about the operation of the boiler.

33. The method of claim 31, wherein said system model is implemented using a neural network.

34. The method of claim 31, wherein said system model is implemented using a mass-energy balance.

35. The method of claim 31, wherein said system model is implemented using genetic programming.

36. The method of claim 31, further including the step of storing information about the control move and corresponding measured boiler performance values and retraining the system model using the stored information.

37. The method of claim 31, wherein said control move is part of a sequence of control moves for incrementally reaching the set of desired sootblower operating settings.

38. A method for controlling the cleanliness in a boiler, one or more heat zones being defined in the boiler, each heat zone having a cleanliness level and being associated with a desired cleanliness level during the operation of the boiler, the performance of the boiler being characterized by boiler performance parameters, comprising the steps of:

implementing a direct controller that determines a set of cleanliness levels in relation to a boiler performance goal;

obtaining a performance goal for the boiler;

checking whether the performance goal is satisfied by the current boiler performance;

if the performance goal is not satisfied, identifying the closest operating region in which the performance goal is satisfied, the operating region being associated with a set of desired cleanliness levels;

outputting the set of desired cleanliness levels.

39. The method of claim 38, wherein at least one heat zone includes a sootblower that operates in accordance with sootblower operating parameters, further comprising the step of adjusting the sootblower operating parameters to attain the desired cleanliness levels.

40. A method for adjusting sootblower operating settings for one or more sootblowers for removing combustion deposits in a boiler, one or more heat zones being defined in the boiler, each sootblower being associated with a heat zone, each heat zone having a cleanliness level and being associated with a desired cleanliness level during the operation of the boiler, the performance of the boiler being characterized by boiler performance parameters, comprising the steps of:

implementing a direct controller that determines the desired sootblower operating settings in relation to a performance goal for the boiler;

obtaining a performance goal for the boiler;

checking whether the performance goal is satisfied by the current boiler performance;

if the performance goal is not satisfied, identifying the closest operating region in which the performance goal is satisfied using the direct controller, the operating region being associated with desired sootblower operating parameters;

determining a control move using the desired sootblower operating parameters for directing the boiler to the operating region; and communicating the control move to said one or more sootblowers.

41. A method for adjusting sootblower operating settings for one or more sootblowers for removing combustion deposits in a boiler, one or more heat zones being defined in the boiler, each sootblower being associated with a heat zone, each heat zone having a cleanliness level and being associated with an adjustable desired cleanliness level during the operation of the boiler, comprising the steps of:

implementing an indirect controller with a system model that relates the sootblower operating settings in the boiler to the cleanliness levels in the boiler;

obtaining data values indicative of the actual cleanliness levels in the boiler and providing them to the indirect controller;

providing the desired cleanliness levels to the direct controller;

determining the desired sootblower operating settings to attain the desired cleanliness levels using the indirect controller;

determining a control move derived from the desired sootblower operating settings; and communicating the control move to said one or more sootblowers.

42. A computer program product, residing on a computer readable medium, for use in controlling removal of combustion deposits from a boiler, the performance of the boiler being characterized by boiler performance parameters, the computer program product comprising instructions for causing a computer to:

obtain a performance goal for the boiler;

receive data corresponding to the boiler performance parameters and boiler state variables;

determine an operating point corresponding to the performance goal using a system model;

identify a set of desired cleanliness levels associated with the operating point using the system model;

determine a control move using the set of desired cleanliness levels for directing the boiler to the operating point; and communicate said control move to a sootblower subsystem.

43. A computer program product, residing on a computer readable medium, for use in controlling removal of combustion deposits from a boiler, the performance of the boiler being characterized by boiler performance parameters, the computer program product comprising instructions for causing a computer to:

obtain a performance goal for the boiler;

receive data corresponding to the boiler performance parameters and boiler state variables;

determine an operating point corresponding to the performance goal using a system model;

identify a set of sootblower operating settings associated with the operating point using the system model;

determine a control move using the set of sootblower operating settings for directing the boiler to the operating point; and communicate said control move to one or more sootblowers to adjust the sootblower operating parameters.

44. A computer program product, residing on a computer readable medium, for use in controlling removal of combustion deposits from a boiler, the performance of the boiler being characterized by boiler performance parameters, the computer program product comprising instructions for causing a computer to:

obtain a performance goal for the boiler;

check whether the performance goal is satisfied by the current boiler performance;

if the performance goal is not satisfied, identify the closest operating region in which the performance goal is satisfied, the operating region being associated with a set of desired cleanliness levels;

determine a control move using the set of desired cleanliness levels for directing the boiler to the operating region; and communicate the control move to a sootblower subsystem.

45. A computer program product, residing on a computer readable medium, for use in controlling removal of combustion deposits from a boiler, the performance of the boiler being characterized by boiler performance parameters, the computer program product comprising instructions for causing a computer to:

obtain a performance goal for the boiler;

check whether the performance goal is satisfied by the current boiler performance;

if the performance goal is not satisfied, identify the closest operating region in which the performance goal is satisfied using the direct controller, the operating region being associated with desired sootblower operating settings;

determining a control move using the desired sootblower operating settings for directing the boiler to the operating region; and communicating the control move to one or more sootblowers.

46. A computer program product, residing on a computer readable medium, for use in controlling removal of combustion deposits from a boiler, the performance of the boiler being characterized by boiler performance parameters, the computer program product comprising instructions for causing a computer to:

obtain data values indicative of actual cleanliness levels in the boiler and provide them to a indirect controller;

provide the desired cleanliness levels to the direct controller;

determine the desired sootblower operating settings to attain the desired cleanliness levels using the indirect controller;

determine a control move corresponding to the desired sootblower operating settings; and communicate the control move to one or more sootblowers.

47. A system for controlling removal of combustion deposits in a boiler, one or more heat zones being defined in the boiler, each heat zone having a cleanliness level and being associated with an adjustable desired cleanliness level during the operation of the boiler, the performance of the boiler being characterized by boiler performance parameters, comprising:

means for receiving a performance goal corresponding to at least one of the boiler performance parameters;

means for receiving data values corresponding to boiler state variables and to the boiler performance parameters, said boiler state variables including current cleanliness levels;

means for modeling the relationship between the cleanliness levels in the boiler and the boiler performance parameters;

means for determining a set of desired cleanliness levels to satisfy the performance goal for the boiler using the system model, the received data values and the received performance goal; and means for outputting the set of desired cleanliness levels.

48. A system for determining desired sootblower operating settings for one or more sootblowers in a boiler, the operation of the one or more sootblowers being characterized by one or more adjustable sootblower operating parameters, the operation of the boiler being characterized by boiler performance parameters, comprising:

means for receiving a performance goal for the boiler corresponding to at least one of the boiler performance parameters;

means for receiving data values corresponding to boiler state variables and to the boiler performance parameters;

means for modeling the relationship between the sootblower operating settings and the boiler performance parameters;

means for determining desired sootblower operating settings to satisfy the received performance goal for the boiler using the system model, the received performance goal for the boiler and the received data values; and means for outputting the desired sootblower operating settings.

49. A system for determining a set of desired cleanliness levels in a boiler, one or more heat zones being defined in the boiler, each heat zone having a cleanliness level and being associated with an adjustable desired cleanliness level during the operation of the boiler, the performance of the boiler being characterized by boiler performance parameters, comprising:

means for receiving a performance goal for the boiler corresponding to at least one of the boiler performance parameters;

means for receiving data values corresponding to boiler state variables and to the boiler performance parameters, said boiler state variables including current cleanliness levels;

means for determining a set of desired cleanliness levels to satisfy the performances goal for the boiler using the received data values and the received performance goal directly; and means for outputting the set of desired cleanliness levels.

50. A system for determining desired sootblower operating settings for a plurality of sootblowers, the operation of the sootblowers being characterized by one or more sootblower operating parameters, in a boiler, the performance of the boiler being characterized by boiler performance parameters, comprising:

means for receiving a performance goal for the boiler corresponding to at least one of the boiler performance parameters;

means for receiving data values corresponding to boiler state variables and the boiler performance parameters;

means for determining desired sootblower operating settings to satisfy the performance goal for the boiler using the received performance goal for the boiler and the received data, values directly; and means for outputting the desired sootblower operating settings.

51. A system for controlling the removal of combustion deposits from a fossil fuel boiler, one or more heat zones being defined in the boiler, each heat zone having a cleanliness level and being associated with an adjustable desired cleanliness level during the operation of the boiler, comprising:

means for sootblowing in at least one of said heat zones in accordance with adjustable operating parameters;

means for detecting an actual cleanliness level of the surface; and means for modeling the relationship between the sootblower operating parameters and desired cleanliness levels;

means for determining values for the adjustable operating parameters using a model, the actual cleanliness level of the surface and the desired cleanliness level for the heat zone; and means for outputting said sootblower operating settings.

* * * * *

UNITED STATES PATENT AND TRADEMARK OFFICE

CERTIFICATE OF CORRECTION

PATENT NO. : 6,736,089 B1
DATED : May 18, 2004
INVENTOR(S) : Lefebvre et al.

It is certified that error appears in the above-identified patent and that said Letters Patent is hereby corrected as shown below:

Column 15,
Line 11, please replace “an in direct controller” with -- an indirect controller --.

Signed and Sealed this

Thirtieth Day of November, 2004

JON W. DUDAS
*Director of the United States Patent and Trademark Office*